US007332866B2

(12) United States Patent
Nakanishi et al.

(10) Patent No.: US 7,332,866 B2
(45) Date of Patent: Feb. 19, 2008

(54) ARC TUBE AND LOW-PRESSURE MERCURY LAMP THAT CAN BE REDUCED IN SIZE

(75) Inventors: Akiko Nakanishi, Takatsuki (JP); Kohhei Iwase, Takatsuki (JP); Kenji Nakano, Kyoto (JP); Kenji Itaya, Takatsuki (JP); Seidou Tani, Yawata (JP); Noriyuki Uchida, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 312 days.

(21) Appl. No.: 10/854,887

(22) Filed: May 27, 2004

(65) Prior Publication Data

US 2004/0263079 A1 Dec. 30, 2004

(30) Foreign Application Priority Data

May 30, 2003 (JP) ..... 2003-155490

(51) Int. Cl.

| | |
|---|---|
| ***H01J 17/04*** | (2006.01) |
| ***H01J 61/04*** | (2006.01) |
| ***H01J 17/00*** | (2006.01) |
| ***H01J 61/00*** | (2006.01) |

(52) U.S. Cl. ..... 313/631; 313/567; 313/491; 313/634; 313/318.01

(58) Field of Classification Search ..... 313/318.01, 313/631

See application file for complete search history.

(56) References Cited

U.S. PATENT DOCUMENTS

| | | | | |
|---|---|---|---|---|
| 3,247,699 | A * | 4/1966 | Heine | 72/371 |
| 4,316,116 | A * | 2/1982 | Graves et al. | 313/344 |
| 4,499,401 | A * | 2/1985 | Graves et al. | 313/315 |
| 6,137,225 | A * | 10/2000 | Heuvelmans et al. | 313/580 |
| 6,336,837 | B1 * | 1/2002 | Maeda | 445/27 |
| 6,633,128 | B2 * | 10/2003 | Ilyes et al. | 313/634 |
| 6,809,477 | B2 * | 10/2004 | Soules et al. | 313/631 |
| 2002/0109462 | A1 * | 8/2002 | Nishio et al. | 315/56 |
| 2003/0151350 | A1 * | 8/2003 | Xu | 313/485 |
| 2003/0234614 | A1 * | 12/2003 | Itaya et al. | 313/634 |

FOREIGN PATENT DOCUMENTS

| | | |
|---|---|---|
| JP | 1-189849 | 7/1989 |
| JP | 2-276148 | 11/1990 |
| JP | 9-171796 | 6/1997 |
| JP | 11-501151 | 1/1999 |
| JP | 2000-294191 | 10/2000 |

* cited by examiner

*Primary Examiner*—Sikha Roy
*Assistant Examiner*—Natalie K. Walford

(57) ABSTRACT

An arc tube includes an arc tube body and a pair of electrodes. The arc tube body is formed from a glass tube which is double-spirally wound from a middle portion to both ends around a spiral axis. The pair of electrodes are sealed at both ends of the arc tube body. Mercury is enclosed in the arc tube substantially in a single form. Each of the electrodes includes a multiple-coiled filament which is wound substantially one turn in a last coiling stage.

9 Claims, 9 Drawing Sheets

ARC TUBE AND LOW-PRESSURE MERCURY LAMP THAT CAN BE REDUCED IN SIZE

This application is based on an application No. 2003-155490 filed in Japan, the contents of which are hereby incorporated by reference.

BACKGROUND OF THE INVENTION

1. Field of the Invention

The present invention relates to an arc tube in which electrodes including filament coils are sealed at ends of an arc tube body, and a low-pressure mercury lamp including the arc tube.

2. Related Art

With the advent of the energy-saving era, research is being performed into low-pressure mercury lamps such as fluorescent lamps. In particular, increasing attention has been given to compact self-ballasted fluorescent lamps as alternative light sources to incandescent lamps. As an example, a compact self-ballasted fluorescent lamp includes a 3U-type arc tube in which three glass tubes bent in the shape of U are connected to form an arc tube body (e.g. Japanese Patent Application Publication H09-231825).

One long discharge space is formed in this 3U-type arc tube. Electrodes are sealed at both ends of this discharge space (i.e. both ends of the arc tube body). Each of the electrodes includes a filament coil and a pair of lead wires supporting both ends of the filament coil.

The filament coil is a multiple-coiled filament which is formed, for example, by double-coiling a wire and then further coiling the double-coiled wire a plurality of turns around a predetermined mandrel.

Each electrode is sealed at the corresponding end of the arc tube body in the following manner. The electrode is inserted into the end of the arc tube body from the filament coil side, until the filament coil reaches a predetermined position in the arc tube body. In this state, the end of the arc tube body is heated and pinched (by application of pressure).

In recent years, there has been an increasing demand for smaller low-pressure mercury lamps. This being so, the need for compact self-ballasted fluorescent lamps which are equal in size to or even smaller than incandescent lamps is growing too. This creates a recent trend toward smaller arc tubes, by reducing the diameter of the glass tube which constitutes the arc tube body to thereby downsize the art tube body.

However, such downsizing of arc tubes causes the following problems. Suppose a glass tube having an inside diameter of 9 mm or less is used to form an arc tube body. A conventional electrode cannot be inserted into such an arc tube body, since a length of a filament coil of the electrode along a coil axis direction is greater than the inside diameter of the glass tube.

If the filament coil is wound with a smaller pitch in the last coiling stage of its multiple coiling stages, the length of the filament coil along the coil axis direction is reduced, with it being possible to seal the electrode at the end of the arc tube body. In this case, however, adjacent winding turns of the filament coil become closer to each other. This being so, if the filament coil touches an inside surface of the arc tube body and becomes deformed when the electrode is being inserted into the arc tube body or if the electrode vibrates when the electrode is being sealed at the end of the arc tube body or when the arc tube is being transported as a completed product, adjacent winding turns may touch each other (this is called a coil touch).

When a coil touch occurs, the filament coil fails to reach a desired temperature when energized. This causes an electron emissive material on the filament coil to remain without being decomposed, which results in a loss of life or a lighting failure of the lamp.

SUMMARY OF THE INVENTION

In view of the above problems, the present invention aims to provide an arc tube in which electrodes can be easily sealed at ends of an arc tube body formed from a small-diameter glass tube, and a low-pressure mercury lamp including such an arc tube.

The stated aim can be achieved by an arc tube including: an arc tube body formed from a glass tube having an inside diameter in a range of 5 mm to 9 mm; and a pair of electrodes sealed at both ends of the arc tube body, each of the electrodes including a multiple-coiled filament which is wound substantially one turn in a last coiling stage.

According to this construction, a length of the multiple-coiled filament along a coil axis direction can be reduced without causing a coil touch that tends to occur in a conventional arc tube in which a multiple-coiled filament is wound a plurality of turns in a last coiling stage.

BRIEF DESCRIPTION OF THE DRAWINGS

These and other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENTS

The following describes embodiments of using an arc tube of the present invention in a compact self-ballasted fluorescent lamp, with reference to drawings. The compact self-ballasted florescent lamp referred to here is a 12 W lamp corresponding to a 60 W incandescent lamp.

First Embodiment

A compact self-ballasted fluorescent lamp to which the first embodiment of the invention relates is described below, by referring to FIGS. 1 to 3.

1. Construction (a) Construction of the Compact Self-ballasted Fluorescent Lamp

Figure 1:
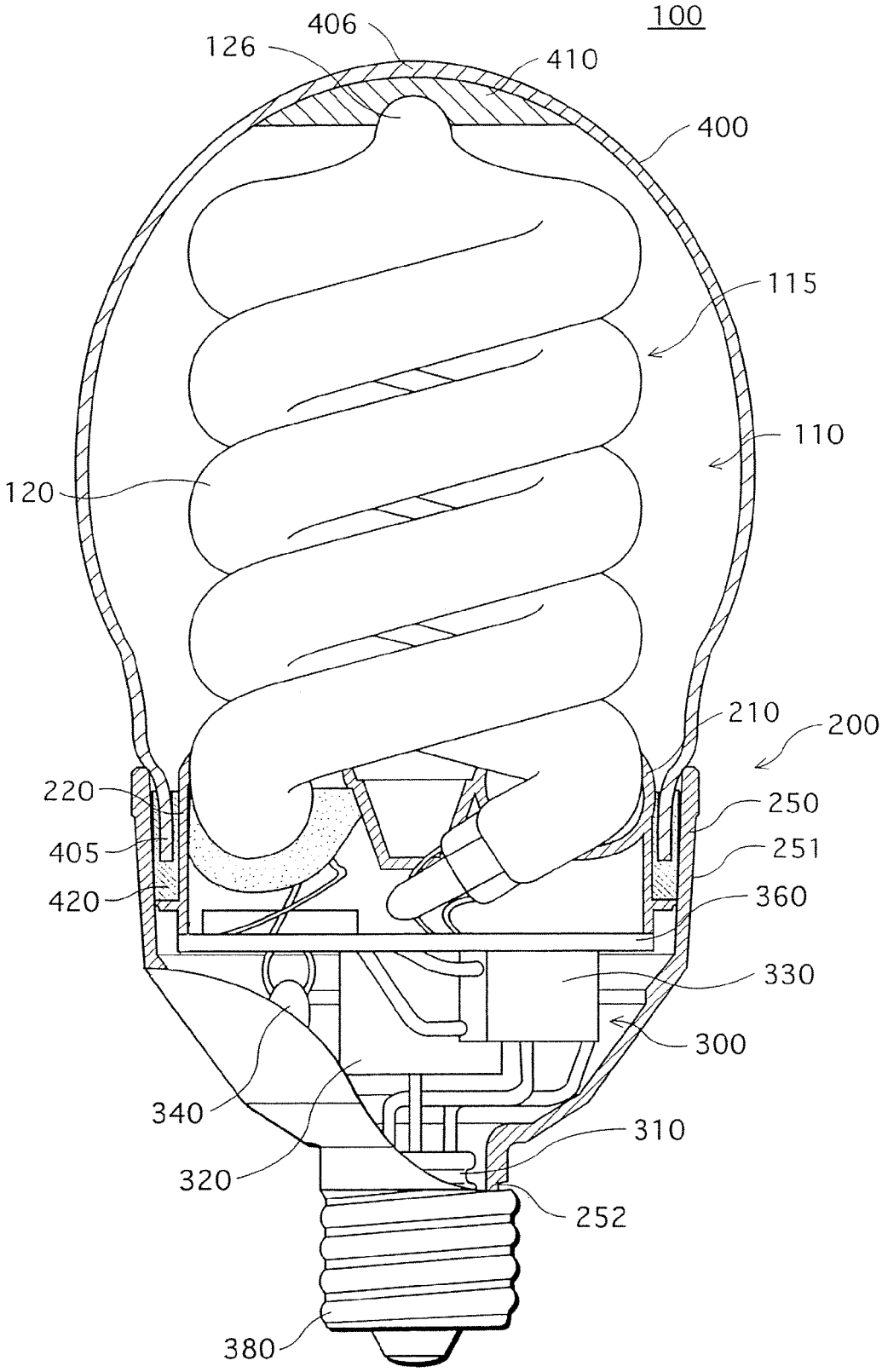
FIG. 1 is a partial cutaway front view of a compact self-ballasted fluorescent lamp in the first embodiment of the invention.

FIG. 1 shows a compact self-ballasted fluorescent lamp 100 in the first embodiment. In the drawing, the compact self-ballasted fluorescent lamp 100 includes a double-spiral arc tube 110, a holder 200 holding the arc tube 110, an electronic ballast 300 housed in the holder 200 for lighting the arc tube 110, and a globe 400 covering the arc tube 110.

The holder 200 includes a cylindrical holding member 210 and a conical case 250. The holding member 210 has insertion openings through which both ends of the arc tube 110 can be inserted, at its end wall. The case 250 covers a circumferential wall 220 of the holding member 210. A screw base 380 of E17-type or the like is attached to a tapered open end 252 of the case 250.

The electronic ballast 300 employs a series-inverter method, and includes a plurality of electric components such as capacitors 310, 330, and 340 and a choke coil 320. These electric components are mounted on a substrate 360 which is attached to the holding member 210. The electronic ballast 300 is designed so that a starting voltage (780 V) is applied to the arc tube 110 at lighting start-up and that a lamp current is 140 mA during lighting.

The globe 400 is made of a glass material that can have a beautiful finish, and is eggplant-shaped, i.e. A-shaped, as in an incandescent lamp. Though the globe 400 is A-shaped in this embodiment, the globe 400 may have a different shape. Also, the globe 400 may be omitted.

An open end 405 of the globe 400 is inserted in a gap between the circumferential wall 220 of the holding member 210 and a circumferential wall 251 of the case 250 covering the circumferential wall 220. The gap contains an adhesive 420. Through this adhesive 420, the globe 400 is fixed to the holding member 210 and the case 250.

An inside surface of a top part 406 of the globe 400 is thermally connected to a projection 126 formed at the top of the arc tube 110, using a heat-conductive medium 410 such as a silicon resin.

By connecting the arc tube 110 and the globe 400 using the heat-conductive medium 410, the arc tube 110 can be brought to such a temperature (about 60° C. to 65° C.) that enables the compact self-ballasted fluorescent lamp 100 to produce a substantially maximum luminous flux, during lighting.

In detail, heat generated from the arc tube 110 when lighting the compact self-ballasted fluorescent lamp 100 is transmitted to the globe 400 via the heat-conductive medium 410, and the transmitted heat is dissipated from the globe 400. This decreases the temperature of the arc tube 110 to the above optimum level. As a result, high performance with a luminous efficiency of 70l m/W is achieved.

(b) Construction of the Arc Tube

Figure 2A:
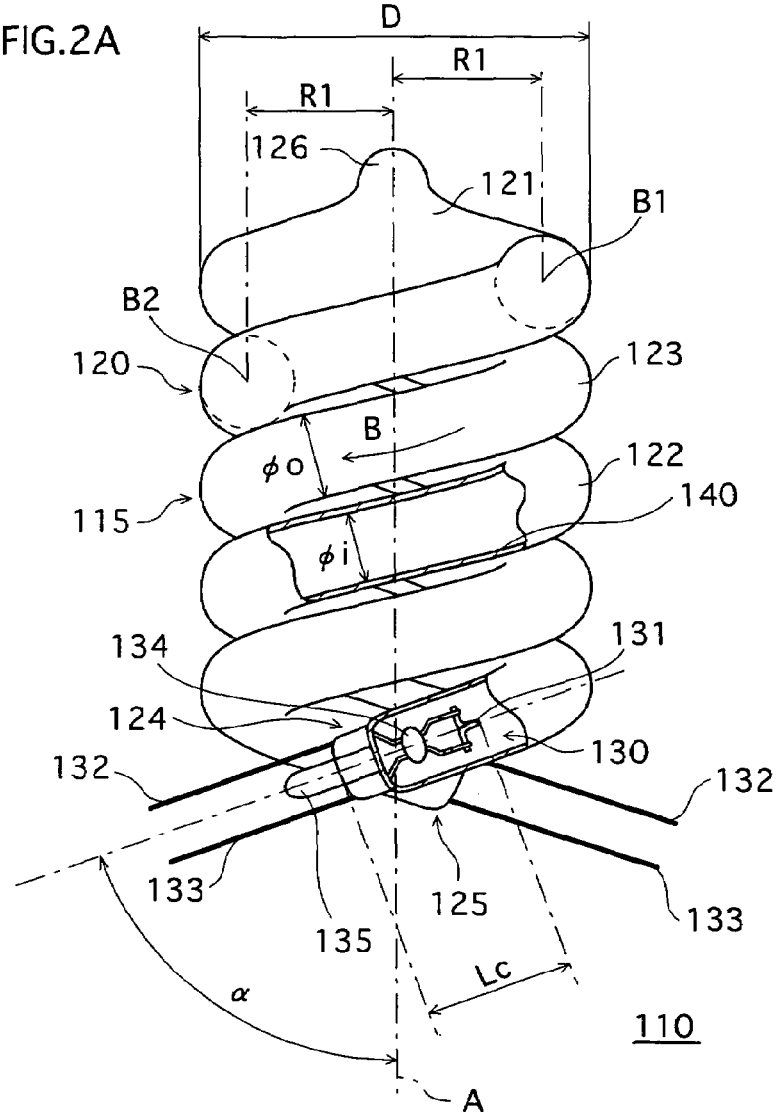
FIG. 2A is a partial cutaway front view of an arc tube in the first embodiment.
Figure 2B:
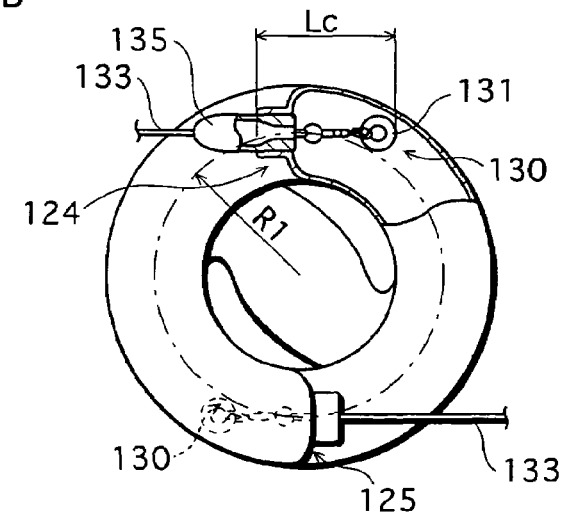
FIG. 2B is a partial cutaway bottom view of the arc tube shown in FIG. 2A.

FIGS. 2A and 2B show the arc tube 110. As illustrated, the arc tube 110 includes an arc tube body 115 formed by bending a glass tube 120, and a pair of electrodes 130 sealed at both ends 124 and 125 of the arc tube body 115. A discharge space is formed in the arc tube body 115, with the ends 124 and 125 of the arc tube body 115 corresponding to ends of the discharge space.

The arc tube body 115 is roughly made up of two spiral units 122 and 123 spirally wound around spiral axis A, and a connecting unit 121 connecting the spiral units 122 and 123. In other words, the glass tube 120 is turned substantially at the middle (corresponding to the connecting unit 121), and two portions of the glass tube 120 that extend from them middle to both ends (corresponding to the spiral units 122 and 123) are spirally wound around spiral axis A in direction B. A direction parallel to spiral axis A is hereafter referred to as a "spiral axis direction".

A tubular axis of each of the spiral units 122 and 123, that is, a tubular axis of the glass tube 120 which forms the spiral units 122 and 123 (indicated as B1 and B2 in FIG. 2A), turns around spiral axis A with turning radius R1, as shown in FIGS. 2A and 2B. A total number of turns of the spiral units 122 and 123 around spiral axis A is about 4.5.

In this embodiment, turning radius R1 is about 13.75 mm as an example.

Outside diameter D of the double spiral structure of the arc tube 110 is preferably in a range of 30 mm to 40 mm, to enable the compact self-ballasted fluorescent lamp 100 including the arc tube 110 to be formed in size (outside diameter) no greater than an incandescent lamp. In this embodiment, outside diameter D is about 36.5 mm as an example.

Inside diameter $\phi_i$, of the glass tube 120 is preferably in a range of 5 mm to 9 mm. If inside diameter $\phi_i$ is smaller than 5 mm, it is difficult to bend the glass tube 120 in a double spiral. If inside diameter $\phi_i$ is greater than 9 mm, a larger electrode distance (distance between electrodes in a discharge space) is required to produce a substantially same luminous flux as an incandescent lamp, with it being impossible to realize a same size as the incandescent lamp. In this embodiment, inside diameter $\phi_i$ is about 7.4 mm as an example, and outside diameter $\phi_o$ of the glass tube 120 is about 9.0 mm as an example.

For instance, the glass tube 120 is made of a soft glass such as strontium-barium silicate glass, and is substantially circular in cross section.

A gap between adjacent turns of the spiral units 122 and 123 in the spiral axis direction excluding portions at or near the ends 124 and 125 is preferably in a range of 1 mm to 3 mm, to limit a total height of the arc tube 110 within a desired range and also to prevent uneven brightness. In this embodiment, the gap between adjacent turns of the spiral units 122 and 123 in the spiral axis direction excluding portions at or near the ends 124 and 125 is about 1 mm as an example.

Meanwhile, the gap between adjacent turns of the spiral units 122 and 123 in the spiral axis direction becomes larger at or near the ends 124 and 125. For example, the spiral units 122 and 123 are wound around spiral axis A to form angle $\alpha$ (e.g. 70°) with spiral axis A near the ends 124 and 125, so that the gap is about 5 mm. By increasing the gap in this way, a working space for sealing the electrodes 130 at the ends 124 and 125 of the arc tube body 115 is created.

A phosphor 140 is applied to an inside surface of the arc tube body 115. For instance, three types of rare-earth phosphors that are a red phosphor ($Y_2O_3$:Eu) a green phosphor ($LaPO_4$:Ce,Tb), and a blue phosphor ($BaMg_2Al_{16}O_{27}$:Eu, Mn) are used as the phosphor 140.

Also, about 5 mg of mercury is enclosed in the arc tube 110 in a single form in this embodiment. The enclosure of mercury is, however, not limited to a single form, so long as a substantially same mercury vapour pressure as when mercury is enclosed in a substantially single form is obtained during lighting. For instance, mercury may be enclosed in an amalgam form such as tin mercury (SnHg) or zinc mercury (ZnHg).

Further, argon is enclosed in the arc tube 110 as a buffer gas, at 400 Pa as an example. As an alternative, a gas mixture of argon and neon may be enclosed as a buffer gas.

Figure 3A:
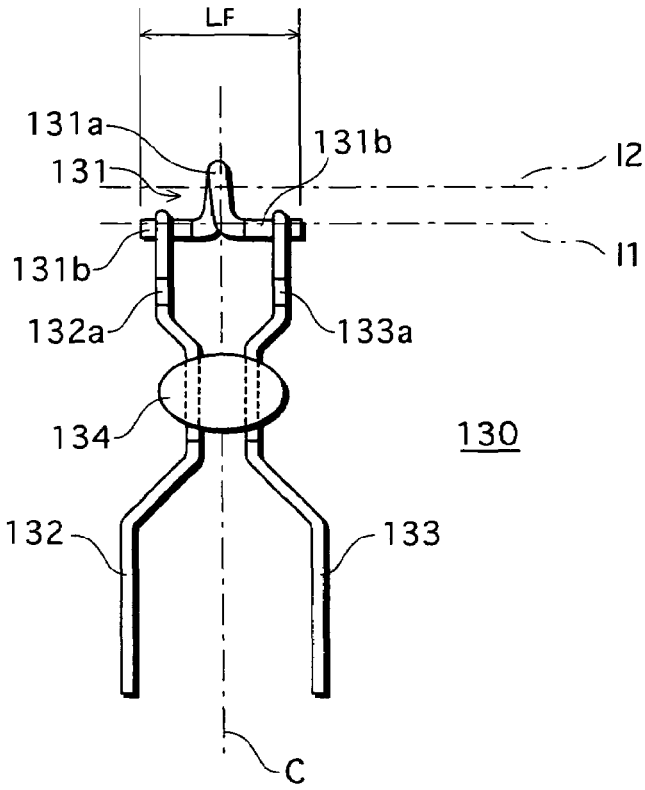
FIG. 3A is a front view of an electrode in the first embodiment.
Figure 3B:
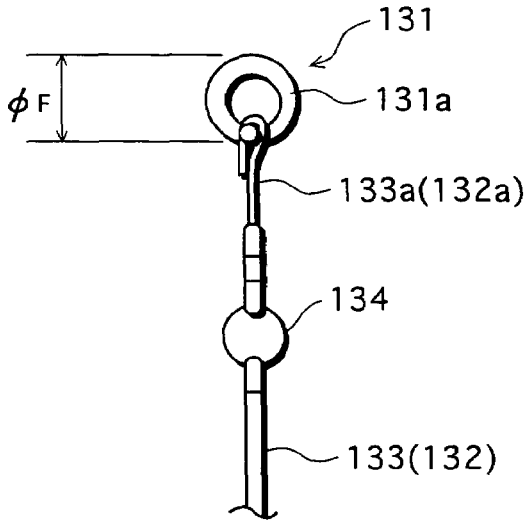
FIG. 3B is a side view of the electrode shown in FIG. 3A.

FIGS. 3A and 3B show the electrode 130 before being sealed at the end 124 or 125 of the arc tube body 115. FIG. 3A is a front view of the electrode 130, whereas FIG. 3B is a side view of the electrode 130.

As shown in FIGS. 2A, 2B, 3A, and 3B, the electrode 130 is roughly made up of a filament coil 131 and a pair of lead wires 132 and 133 which support the filament coil 131 at both ends. The pair of lead wires 132 and 133 are held by a bead 134 (bead mounting method).

The filament coil 131 is a multiple-coiled filament which is wound substantially one turn in a last coiling stage (described in detail later) This being so, the filament coil 131 includes a turn part 131*a* made up of substantially one winding turn, and a pair of extension parts 131*b* which extend from both sides of the turn part 131*a*. These extension parts 131*b* extend in a direction that is parallel to coil axis I2 around which the turn part 131*a* turns (i.e. a horizontal direction in FIG. 3A) Also, the extension parts 131*b* extend from both sides of the turn part 131*a* in opposite directions.

If the turn part 131*a* is made up of one winding turn, the extension parts 131*b* on both sides of the turn part 131*a*form substantially one straight line. This allows the filament coil 131 to be supported stably by the lead wires 132 and 132. As can be seen in FIG. 3A, the turn 131*a* is spirally wound, and because there is an angle between parts of turn 131*a* and cross-section C, the turn 131*a* does not exist in one plane.

Coil axis I2 of the turn part 131*a* is located on a side of straight-line segment I1 connecting the extension parts 131*b*, that is opposite to the bead 134. This means the turn part 131*a* which turns around coil axis I2 is a farthest portion of the filament coil 131 from the bead 134.

Accordingly, the filament coil 131 can be coated with an electron emissive material simply by immersing the filament coil 131 alone in a suspension containing the electron emissive material. Hence the suspension is prevented from adhering to the lead wires 132 and 133 that support the filament coil 131. A more detailed construction of the turn part 131*a* of the filament coil 131 is explained later.

Portions of the leadwires 132 and 133 on the filament coil side of the bead 134 are bent substantially at the middle so as to hook on the extension parts 131*b* of the filament coil 131, as shown in FIG. 3B. In this way, the filament coil 131 is supported by the lead wires 132 and 133 at both ends.

The lead wires 132 and 133 are positioned substantially in parallel with each other so as to be substantially symmetrical with respect to central axis C, as shown in FIG. 3A. Coil axis I2 of the turn part 131*a* is substantially orthogonal to central axis C.

Portions of the lead wires 132 and 133 on an opposite side of the bead 134 to the filament coil side are partly sealed at each of the ends 124 and 125 of the arc tube body 115, using pinching (by application of pressure) or the like. This seals the electrodes 130 at the ends 124 and 125 of the arc tube body 115 and makes the inside of the arc tube body 115 airtight.

As a result of sealing the ends 124 and 125 of the arc tube body 115 together with the electrodes 130, a space is created inside the arc tube body 115 (i.e. a discharge space of the arc tube 110). A distance between the filament coils 131 of the electrodes 130 in this space (i.e. an electrode distance) is about 400 mm as an example.

For instance, the filament coil 131 is made of a tungsten wire, whilst the lead wires 132 and 133 are made of an iron-nickel-chromium alloy. As the electrode emissive material, BaO—SrO—CaO—Zr is used as an example.

As shown in FIGS. 2A and 2B, the filament coil 131 is positioned in the arc tube 110 so that minimum distance Lc between the insertion tip of the filament coil 131 and an end surface of each of the ends 124 and 125 of the arc tube body 115 (excluding a narrow tube 135 at the end 124) is 0.6 times curvature radius R2 (R2=D/2) of the arc tube 110. In this embodiment, therefore, the filament coil 131 is positioned so that the insertion tip is about 11 mm away from the end surface of each of the ends 124 and 125 of the arc tube body 115.

The narrow tube 135 is sealed together with the electrode 130 at the end 124 of the arc tube body 115. This narrow tube 135 is used to exhaust the arc tube body 115 and to enclose mercury, a buffer gas, and the like in the arc tube body 115. The narrow tube 135 is sealed at its tip using a tip-off method or the like, after exhausting the arc tube body 115 and enclosing mercury and a buffer gas in the arc tube body 115.

(c) Construction of the Filament Coil

The filament coil 131 is a multiple-coiled filament that is formed by coiling a filament 900 such as a tungsten wire mentioned earlier, in at least two stages. In this embodiment, the filament coil 131 is a triple-coiled filament formed by coiling a filament 900 in three stages. A manufacturing method of the filament coil 131 which is a triple-coiled filament is shown in FIGS. 9 and 10 and explained briefly below.

Figure 9:
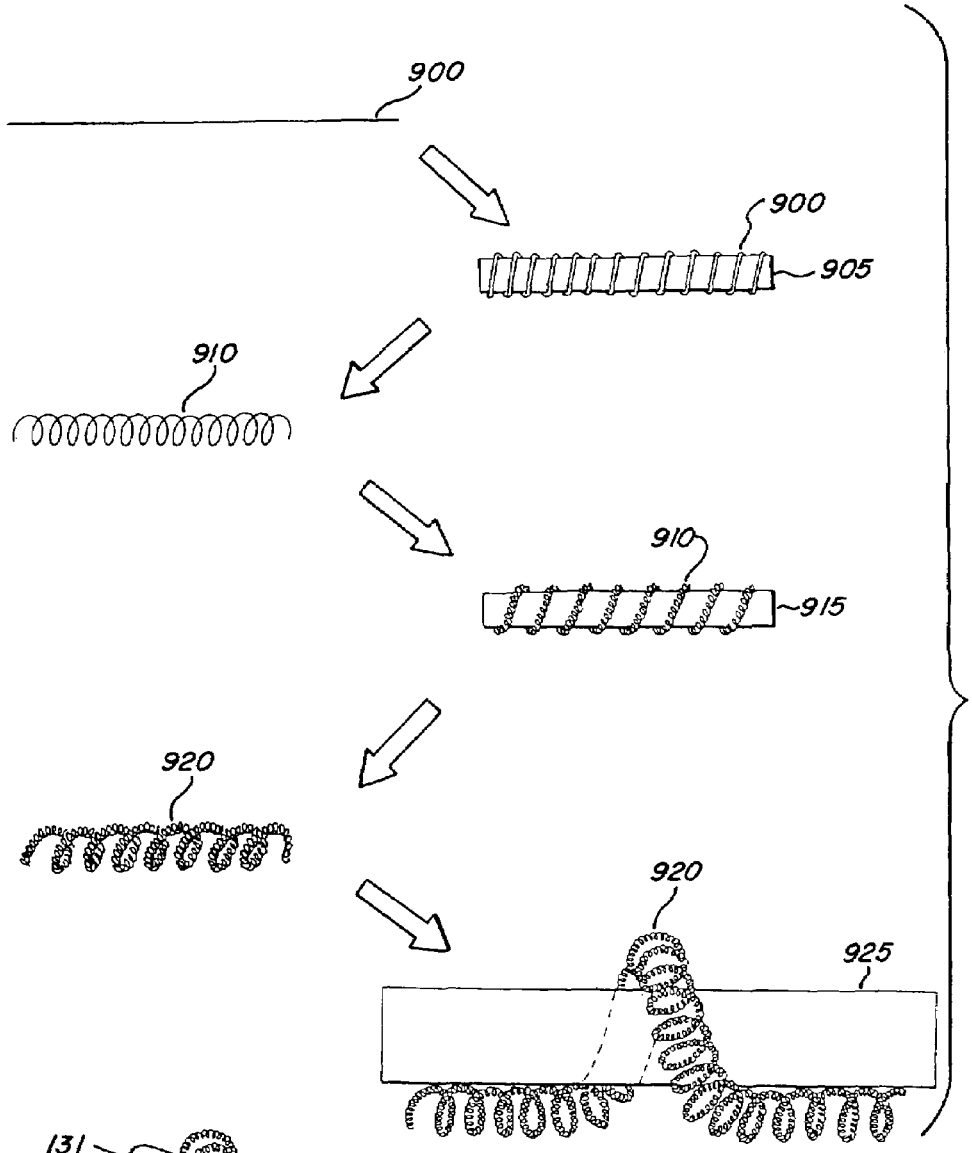
FIG. 9 is a schematic to disclose manufacturing the filament coil.
Figure 10:
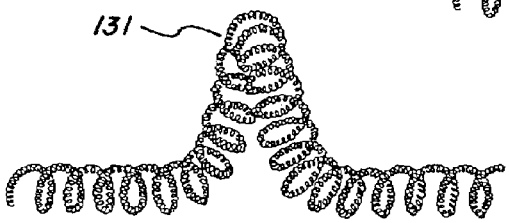
FIG. 10 is an elevated view of the filament coil.

First, a filament 900 (e.g. 36 μm in diameter) is wound on a first mandrel 905 having a predetermined outside diameter at a first pitch, into a coiled structure (a primary coil) 910 as shown in FIG. 9. The coil diameter is not drawn to scale for illustrative purposes. This primary coil 910 is itself wound on a second mandrel 915 having a predetermined outside diameter at a second pitch, into a coiled structure (a secondary coil) 920.

Lastly, the secondary coil 920 is wound on a third mandrel 925 having a predetermined outside diameter at a third pitch (e.g. 1.2 mm), so that the secondary coil 920 is wound substantially one turn. This produces the final filament coil 131 which is a triple-coiled filament. The filament coil 131 obtained in this way has a resistance of cold filament of 9Ω when used as an electrode.

Outside diameter $\phi_F$ of the turn part 131*a* of the filament coil 131 shown in FIG. 3B is preferably set such that a minimum distance between the turn part 131*a* and the inside surface of the glass tube 120 is no smaller than 0.5 mm. If the minimum distance between the turn part 131*a* and the inside surface of the arc tube body 115 is smaller than 0.5 mm, a temperature of the filament coil 131 increases abnormally when the compact self-ballasted fluorescent lamp 100 approaches the end of life. In this embodiment, outside diameter $\phi_F$ is about 2.2 mm as an example.

Also, length $L_F$ the filament coil 131 along the direction of coil axis 12 shown in FIG. 3A is preferably at least 1.6 mm smaller than inside diameter $\phi_i$ of the glass tube 120. This eases the insertion of the electrodes 130 into the ends 124 and 125 of the arc tube body 115. In this embodiment, length LF is about 5.2 mm as an example.

2. Electrode Sealing

The electrodes 130 having the above construction are sealed at the ends 124 and 125 of the arc tube body 115, in the following manner. Though the following explanation concerns the sealing of the electrode 130 at the end 124 of the arc tube body 115 as an example, the same applies to the sealing of the electrode 130 at the end 125 of the arc tube body 115.

First, the double-spiral arc tube body 115 and the electrode 130 in which the filament coil 131 is supported by the pair of lead wires 132 and 133 are prepared. Note here that the inside surface of the arc tube body 115 is coated with the phosphor 140.

The electrode 130 is inserted into the arc tube body 115 at the end 124, so that distance Lc between the insertion tip of the filament coil 131 and the end surface of the end 124 is about 11 mm.

In this state where the electrode 130 is partly inserted in the arc tube body 115, the end 124 of the arc tube body 115 is heated using a gas burner or the like, and the softened and melted end 124 is pressed using a pinch block. As a result, middle portions of the lead wires 132 and 133 of the electrode 130 adhere to the end 124 in a melted state.

Here, length $L_F$ of the filament coil 131 along the direction of coil axis 12 is about 1.6 mm smaller than inside diameter $\phi_i$ of the glass tube 120. Accordingly, the electrode 130 can be easily inserted into the end 124 of the arc tube body 115. Also, the electrode 130 is inserted in the arc tube body 115 such that distance $L_c$ between the insertion tip of the filament coil 131 and the end surface of the end 124 of the arc tube body 115 is about 11 mm. Hence the insertion tip of the filament coil 131 will not touch the inside surface of the arc tube body 115.

The turn part 131*a* of the filament coil 131 is made up of substantially one winding turn. Accordingly, even if the filament coil 131 touches the inside surface of the arc tube body 115 and become deformed when the electrode 130 is being inserted into the arc tube body 115, a coil touch, i.e. a touch between adjacent winding turns, will not occur.

Note that if the filament coil 131 touches the inside surface of the arc tube body 115, the temperature of the filament coil 131 increases abnormally at the end of lamp life.

3. Lamp Performance

A performance test was conducted on the compact self-ballasted fluorescent lamp 100 having the above construction. In the performance test, a luminous flux and a rating life of the compact self-ballasted fluorescent lamp 100 were measured under the following lighting conditions.

Applied voltage: AC 100 V (60 Hz in frequency)

Temperature during lighting: 25° C.

Lighting state: base-up lighting

Lamp input: 12 W

In the performance test, the compact self-ballasted fluorescent lamp 100 delivered performance of a luminous flux of 820 lm and a rating life of 6000 hours or longer. This performance is substantially at a same level as a conventional 3U-type compact self-ballasted fluorescent lamp.

A rating life mentioned here is a time measured until a lamp ceases to light in a repeated test of turning the lamp on for 2.75 hours and then turning it off for 0.25 hours. Here, the double-spiral arc tube 110 and the compact self-ballasted fluorescent lamp 100 of this embodiment are referred to as the spiral-type, to distinguish them from a conventional 3U-type arc tube and compact self-ballasted fluorescent lamp used as a comparative example.

The 3U-type compact self-ballasted fluorescent lamp has a height of 122 mm, and a glass tube forming an arc tube body of the 3U-type arc tube has an inside diameter of 9.15 mm and an outside diameter of 10.75 mm.

(1) Luminous Flux

Mercury is enclosed in the 3U-type arc tube in an amalgam form, to adjust a mercury vapour pressure during lighting. The amalgam form referred to here differs from the aforementioned amalgam form such as tin mercury and zinc mercury, and indicates such a form with which a temperature at which a substantially maximum luminous efficiency is obtained is higher than when mercury is enclosed in a single form.

On the other hand, mercury is enclosed in the spiral-type arc tube 110 in a substantially single form. Nevertheless, the spiral-type compact self-ballasted fluorescent lamp 100 emitted a substantially same luminous flux as the 3U-type compact self-ballasted fluorescent lamp.

A reason for this is explained below. The glass tube 120 forming the spiral-type arc tube 110 has inside diameter $\phi_i$ of 7.4 mm. This allows the arc tube 110 during lighting to be brought to such a temperature (mercury vapour pressure) that maximizes a luminous flux. As a result, a high luminous flux can be obtained.

(2) Rating Life

The filament coil 131 used in the spiral-type arc tube 110 is smaller in size than a filament coil used in the 3U-type compact self-ballasted fluorescent lamp corresponding, for example, to a 60 W incandescent lamp. Nevertheless, the spiral-type arc tube 110 showed a substantially same rating life as the 3U-type.

A reason for this is explained below. Through analysis, the inventors of the invention succeeded in setting a starting voltage (750 V) of the spiral-type arc tube 110 to be lower than a starting voltage (1050 V) of the conventional 3U-type arc tube (a reason for this is explained later). Such a decrease in starting voltage reduces the effect of sputtering on the filament coil 131, and prevents consumption of the electron emissive material.

This allows a thinner filament to be used for the filament coil 131. If the filament is thinner, a desired resistance can be obtained even when, for example, the filament is shorter. A shorter filament means the filament coil 131 is coated with a fewer amount of electron emissive material. However, the lamp life is prolonged as a result of slower consumption of the electron emissive material at lighting start-up. Hence a desired rating life of 6000 hours can be achieved.

(3) Lower Starting Voltage

Mercury is enclosed in the 3U-type arc tube in an amalgam form, to increase the luminous efficiency and luminous flux during lighting. On the other hand, mercury is enclosed in the spiral-type arc tube in a single form. This difference causes a mercury vapour pressure during non-lighting to be higher in the spiral-type than in the 3U-type. For this reason, the spiral-type has a lower starting voltage than the 3U-type.

Another reason for the lower starting voltage of the spiral-type arc tube is that the double-spiral shape of the spiral-type arc tube allows thermal electrons to move smoothly inside the arc tube. In the 3U-type arc tube, connecting unit switch connect U-shaped glass tubes are orthogonal to portions of the U-shaped glass tubes around the connecting units. Also, the connecting units have a smaller inside diameter than the U-shaped glass tubes. This makes it difficult for thermal electrons to move smoothly inside the arc tube.

Second Embodiment

In the first embodiment, the arc tube body 115 is formed using the small-diameter glass tube 120, and mercury is enclosed in the arc tube body 115 in a substantially single form. By doing so, the starting voltage of the compact self-ballasted fluorescent lamp 100 can be decreased when compared with the 3U-type, and the filament coil 131 can be reduced in size. Also, the electrodes 130 can be stably sealed at the ends 124 and 125 of the arc tube body 115, while maintaining performance such as a luminous flux and a lamp life at a same level as the 3U-type.

In the second embodiment, the electrodes 130 of the first embodiment are modified so as to be more easily sealed at the ends 124 and 125 of the double-spiral arc tube body 115.

In the first embodiment, each of the electrodes 130 is roughly made up of the filament coil 131 which is a triple-coiled filament wound substantially one turn in the third coiling stage, the pair of lead wires 132 and 133 for supporting both ends of the filament coil 131, and the bead 134 for fixing the pair of lead wires 132 and 133, as shown in FIGS. 3A and 3B. As can be seen from FIG. 3A, portions 132*a* and 133*a* of the lead wires 132 and 133 on the filament coil side of the bead 134 are substantially straight.

Meanwhile, the ends 124 and 125 of the arc tube body 115 at which the electrodes 130 are sealed are curved (circular when viewed from the spiral axis direction), because of the double-spiral shape of the arc tube body 115. This being so, when the electrode 130 having the substantially straight lead wires 132 and 133 is inserted into each of the ends 124 and 125 of the arc tube body 115, the filament coil 131 may touch the inside surface of the arc tube body 115.

In view of this, an electrode construction which is less likely to touch the inside surface of the double-spiral arc tube body 115 when inserted into the arc tube body 115 is described below.

1. Electrode Construction

Electrodes 530, 630, and 730 of the second embodiment are each a modification to the electrodes 130 of the first embodiment. In detail, the pair of lead wires 132 and 133 are bent (curved or angled) along the shape of each of the ends 124 and 125 of the double-spiral arc tube body 115.

As shown in FIG. 2B, the electrodes 130 are pinched at the ends 124 and 125 of the arc tube body 115 in such a manner as to sandwich a plane substantially orthogonal to a radial direction of the arc tube body 115 from both sides. The plane substantially orthogonal to the direction in which the ends 124 and 125 of the arc tube body 115 are pinched (the radial direction of the arc tube body 115) is hereafter called a "pinch plane".

(a) First Example

Figure 4A:
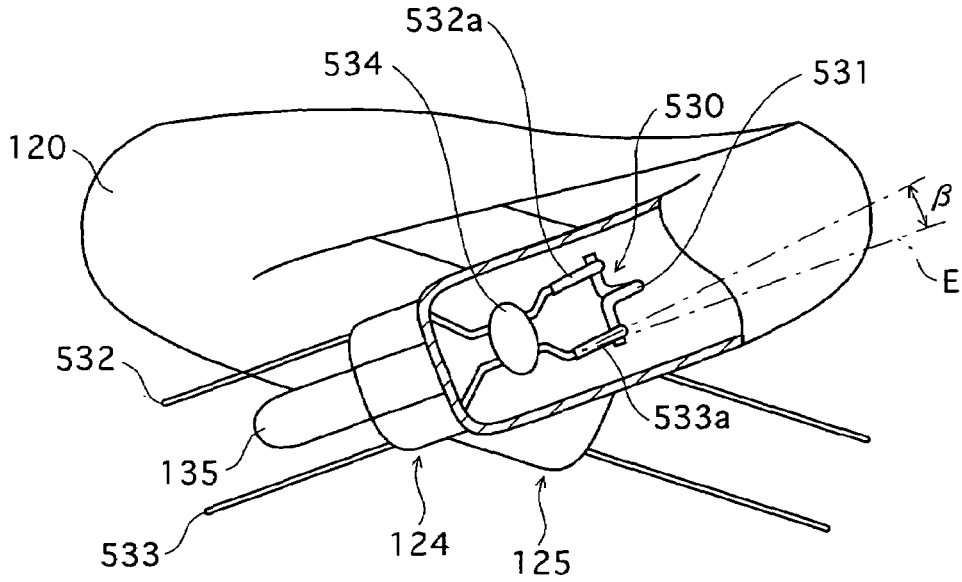
FIG. 4A is a magnified partial cutaway front view of an end of an arc tube body in the second embodiment of the invention.
Figure 4B:
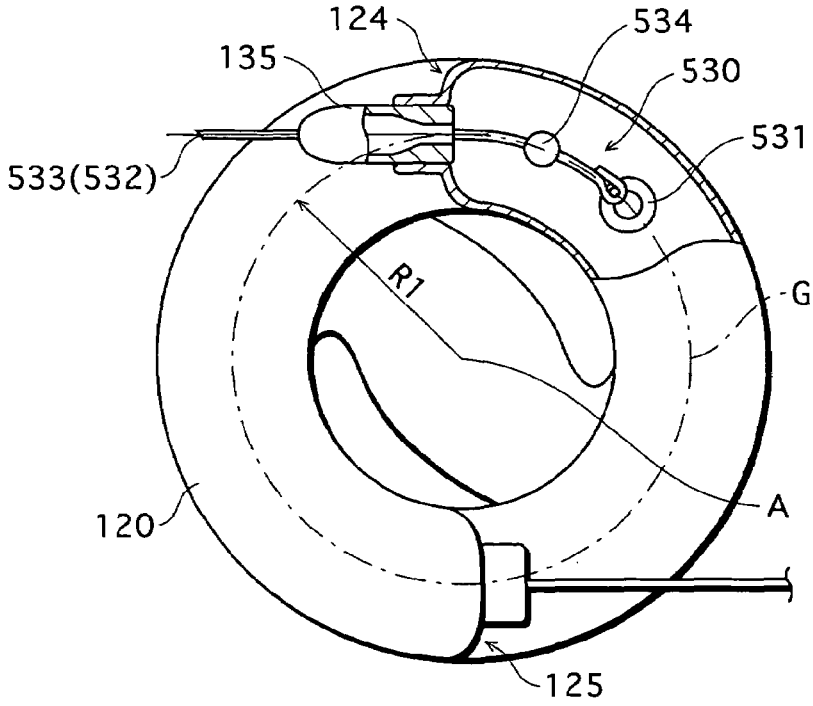
FIG. 4B is a partial cutaway bottom view of the end of the arc tube body shown in FIG. 4A.

FIGS. 4A and 4B show a state where an electrode 530 which is the first example of the second embodiment is sealed at each of the ends 124 and 125 of the arc tube body 115. In these drawings, part of the end 124 is cut away to illustrate the electrode 530 in detail.

When the electrode 530 is viewed from the direction orthogonal to the pinch plane (which is parallel to the paper surface of FIG. 4A), portions 532*a* and 533*a* of a pair of lead wires 532 and 533 on a filament coil side of a bead 534 are angled (inclined) along the end 124 of the arc tube body 115, as shown in FIG. 4A.

In more detail, the portions 532*a* and 533*a* of the lead wires 532 and 533 are angled by angle β toward the connecting unit 121 of the arc tube body 115, with respect to a direction (indicated by line segment E) that is parallel to a central axis of the electrode 530 (corresponding to central axis C shown in FIG. 3).

Angle β is determined by angle α at which the end 124 of the arc tube body 115 turns around spiral axis A and also by the extent of insertion of a filament coil 531 in the arc tube body 115. Angle β is preferably in a range of about $0° < \beta < 30°$. In this embodiment, angle β is set at 13° as an example.

Such an electrode 530 can be obtained from the electrode 130 of the first embodiment in the following manner. While holding the bead 134 of the electrode 130, the portions of the lead wires 132 and 133 on the filament coil side of the bead 134 are bent at their bases by angle β with respect to the direction parallel to central axis C of the electrode 130.

Also, when the electrode 530 is viewed from the spiral axis direction, portions of the lead wires 532 and 533 to be positioned within the arc tube body 115 are curved along the end 124 of the arc tube body 115, as shown in FIG. 4B.

In more detail, the portions of the lead wires 532 and 533 to be positioned within the arc tube body 115 are curved along the tubular axis of the glass tube 120 which turns around spiral axis A with turning radius R1. To curve the lead wires 532 and 533 in this way, for example, the lead wires 532 and 533 are deformed along a circumferential surface of a die having a desired curvature radius.

(b) Second Example

Figure 5A:
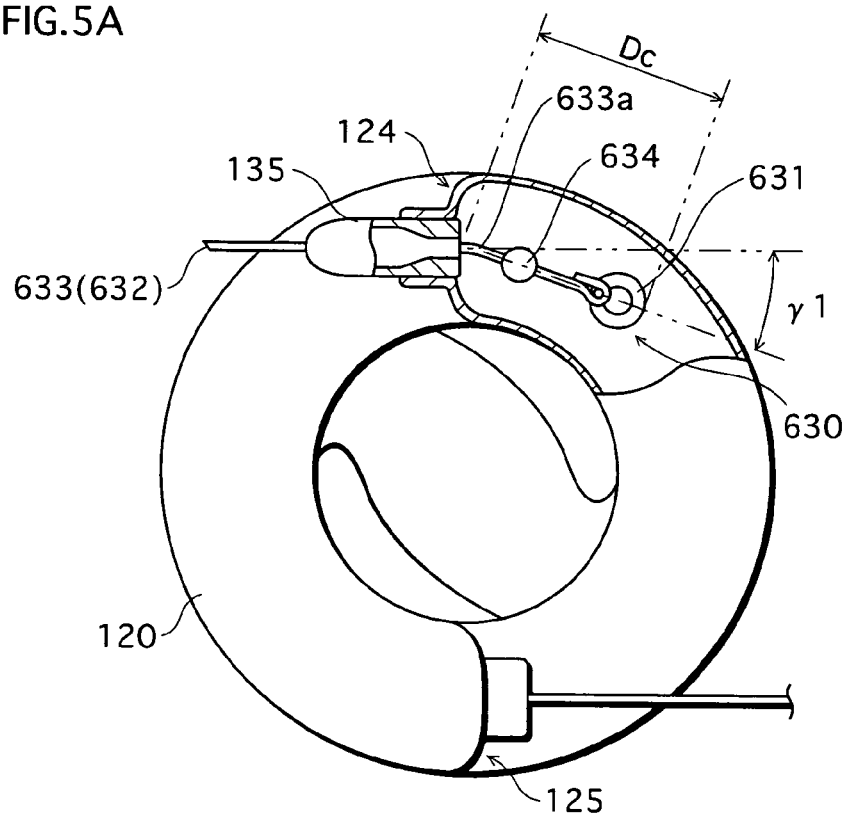
FIG. 5A shows an example electrode in the second embodiment.
Figure 5B:
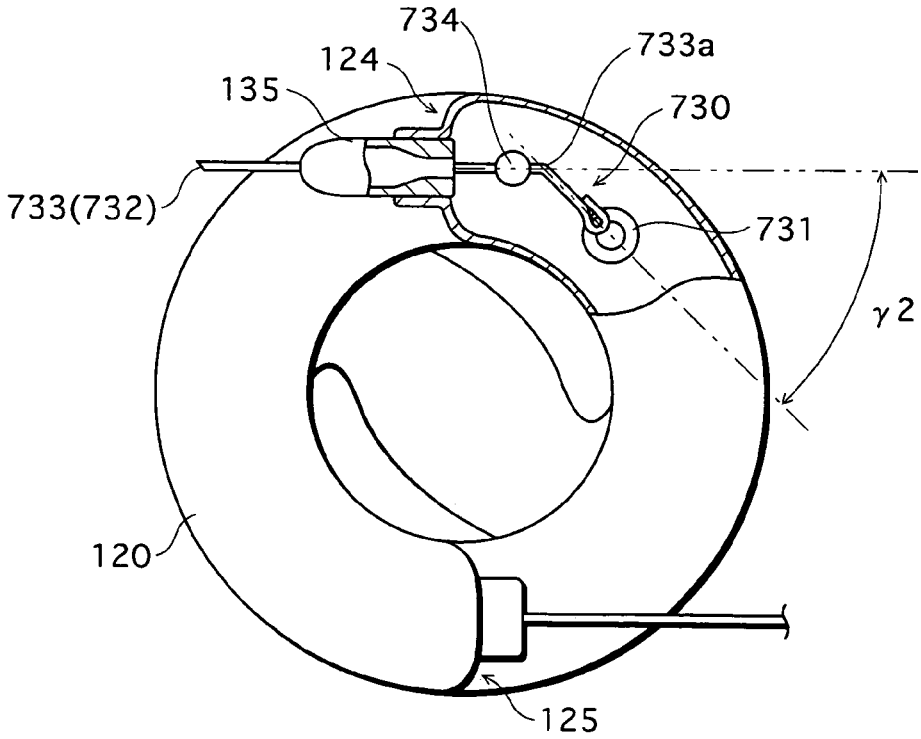
FIG. 5B shows an example electrode in the second embodiment.

FIGS. 5A and 5B respectively show states where electrodes 630 and 730 which are the second example of the second embodiment are sealed at each of the ends 124 and 125 of the arc tube body 115, when viewed from the spiral axis direction. Here, part of the end 124 is cut away to illustrate the electrodes 630 and 730 in detail.

In FIG. 5A, a pair of lead wires 632 and 633 of the electrode 630 are angled at at least one point (633*a*) in the discharge space of the arc tube 110, at angle γ1 with respect to the pinch plane (which is orthogonal to the paper surface of FIG. 5A). In FIG. 5B, a pair of lead wires 732 and 733 of the electrode 730 are angled at at least one point (733*a*) in the discharge space of the arc tube 110, at angle γ2 with respect to the pinch plane.

In more detail, if a distance between a discharge space side of the sealed part of the arc tube 110 and the angled point of the lead wires is less than half of distance Dc between the discharge space side of the sealed part and the insertion tip of the filament coil as in the case of FIG. 5A, the lead wires are angled with angle γ1 which is in a range of $0° < \gamma 1 < 60°$.

For example, the lead wires 632 and 633 of the electrode 630 are angled at the angled point 633*a* which is 1 mm away from the discharge space side of the sealed part, by angle $\gamma 1 = 20°$.

Conversely, if the distance between the discharge space side of the sealed part and the angled point of the lead wires is no less than half of distance Dc between the discharge space side of the sealed part and the insertion tip of the filament coil as in the case of FIG. 5B, the lead wires are angled with angle γ2 which is in a range of $30° < \gamma 2 < 90°$.

The lead wires 632 and 633 and the lead wires 732 and 733 can be angled at the angled points 633*a* and 733*a* as shown in FIGS. 5A and 5B through the use of dies as mentioned above.

(c) Insertion of the Filament Coil into the Arc Tube Body

In the electrode 530 (630, 730) of the second embodiment, part of the pair of lead wires 532 and 533 (632 and 633, 732 and 733) to be positioned within the arc tube body 115 is deformed along each of the ends 124 and 125 of the arc tube body 115. Accordingly, if the electrode 530 (630, 730) is inserted into each of the ends 124 and 125 straightly, the filament coil 531 (631, 731) may touch the inside surface of the arc tube body 115.

This can be avoided by inserting the filament coil 531 (631, 731) along the tubular axis of the glass tube 120 which turns around spiral axis A with turning radius R1.

This is explained in detail below, using the electrode 530 as an example.

Figure 6A:
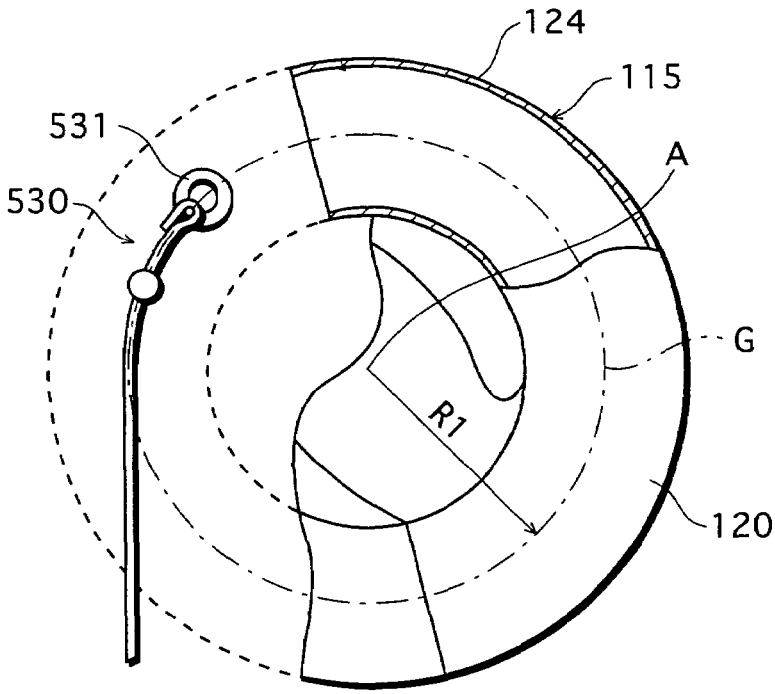
FIGS. 6A and 6B show how an electrode is inserted into the end of the arc tube body in the second embodiment.

First, the electrode 530 is positioned so that part of the electrode 530 to be inserted into the arc tube body 115 is on track G of the tubular axis of the glass tube 120 that turns around spiral axis A with turning radius R1, as sown in FIG. 6A.

Figure 6B:
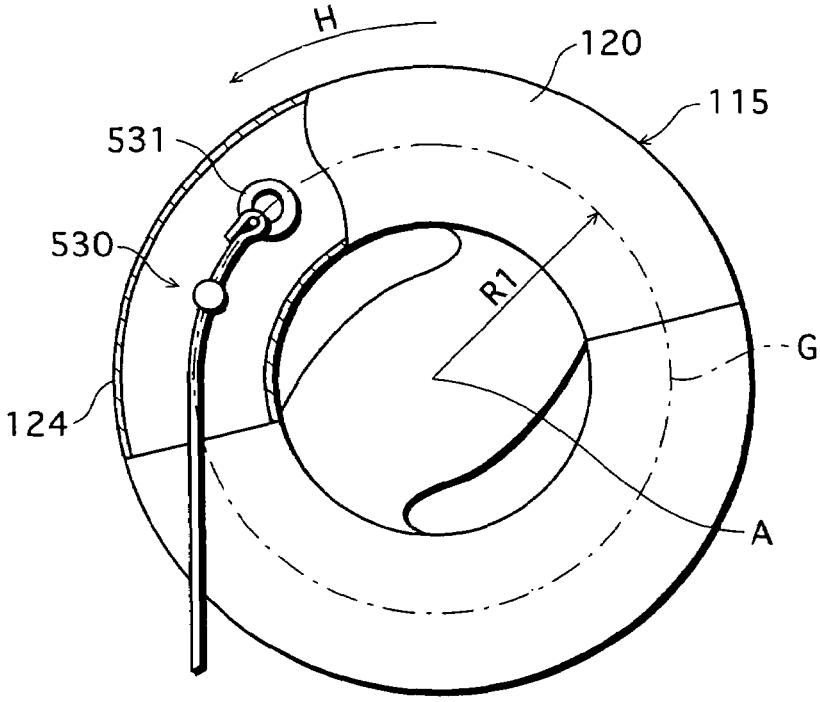

Following this, the arc tube body 115 is rotated about spiral axis A in direction H, as shown in FIG. 6B. By doing so, the electrode 530 can be smoothly inserted into the end 124 of the arc tube body 115.

In this example, the arc tube body 115 is rotated while the electrode 530 is fixed. Alternatively, the electrode 530 may be rotated about spiral axis A while fixing the arc tube body 115, to insert the electrode 530 into the arc tube body 115. Also, the arc tube body 115 and the electrode 530 may both be rotated to insert the electrode 530 into the arc tube body 115.

It should be noted that the electrode shapes of the above first and second examples may be combined.

MODIFICATIONS

The present invention has been described by way of the above embodiments, though it should be obvious that the invention is not limited to the above. Example modifications are given below.

(1) The above embodiments describe the case where the electrode is sealed with the pinch plane being orthogonal to the radial direction of the arc tube body, but the pinch plane is not limited to such.

Figure 7:
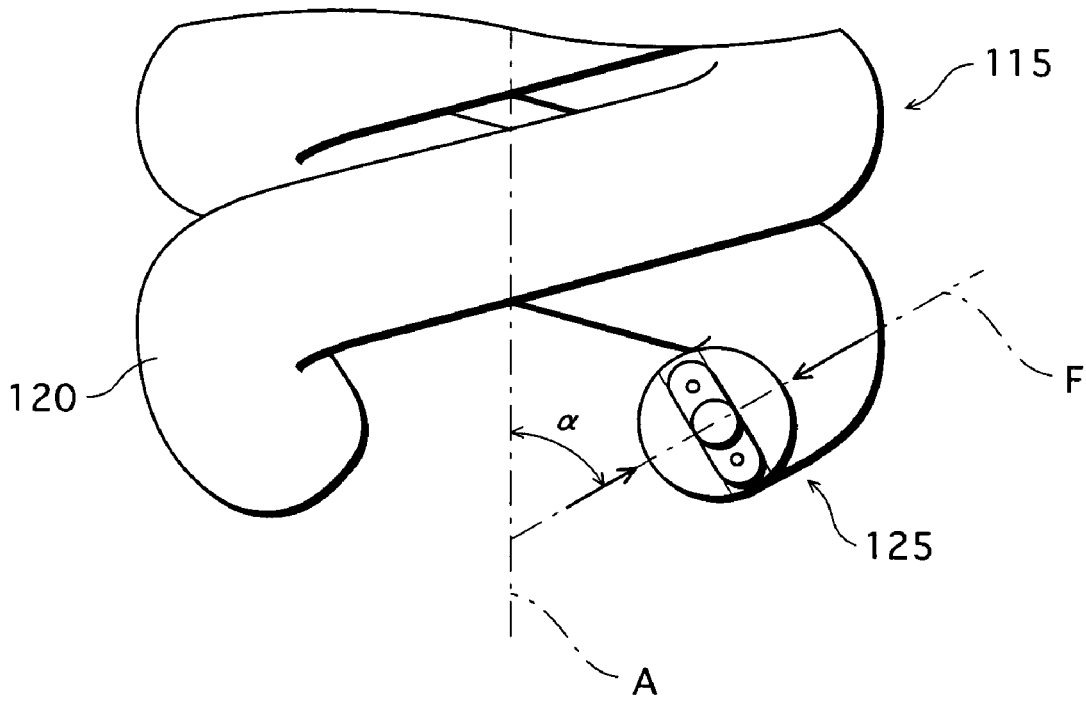
FIG. 7 shows a pinch direction in a modification to the embodiments.

An example of this modification is shown in FIG. 7. In the drawing, a direction (indicated by arrow F) in which the ends 124 and 125 of the arc tube body 115 are pinched in an electrode sealing process has same angle $\alpha$ as the ends 124 and 125 of the arc tube body 115 with respect to spiral axis A. The same effects as the above embodiments can be achieved in this case too.

(2) The above embodiments describe the case where the invention is applied to a spiral-type arc tube and compared with a conventional3U-type arc tube. However, the invention is equally applicable to a 3U-type arc tube. The inventors of the invention found out that the starting voltage can be decreased and the consumption of the filament and the electron emissive material can be reduced by enclosing mercury in the arc tube body in a substantially single form (including an amalgam form having same mercury vapour pressure properties as a single form).

The above performance test indicates that the starting voltage can be decreased in the 3U-type if mercury is enclosed not in an amalgam form conventionally used in the 3U-type but in a substantially single form. This enables the use of a multiple-coiled filament which is wound substantially one turn in a last coiling stage, as in the above embodiments. Furthermore, the arc tube shape is not limited to spiral and 3U, as a multiple-coiled filament wound substantially one turn in a last coiling stage can be equally used in a straight-type arc tube and a circular-type arc tube.

It should be noted, however, that thermal electrons can be more smoothly moved within the discharge space in the spiral type than in the 3U type, so that the effects may somewhat decrease when the invention is applied to the 3U-type.

Given that the arc tube shape is not limited to a particular shape, the invention is equally applicable to cases where inside diameter $\phi_t$ of the glass tube is smaller than 5 mm. For example, it may be possible to form a double-spiral arc tube using a glass tube having an inside diameter smaller than 5 mm, if optimal conditions are employed when bending the glass tube. A double-spiral structure formed using a glass tube having an inside diameter smaller than 5 mm can possibly have an outside diameter smaller than 30 mm. This allows further reduction in arc tube size.

(3) The above embodiments describe the case where the invention is used in a compact self-ballasted fluorescent lamp corresponding to a 60 W incandescent lamp, but this is not a limit for the invention. The invention may be equally used in a compact self-ballasted fluorescent lamp corresponding to a 40 W or 100 W incandescent lamp, though the height of the arc tube, i.e. the number of turns of the glass tube, needs to be adjusted in such cases.

(4) The above embodiments describe the case when the invention is used in a compact self-ballasted fluorescent lamp, but the invention can instead be used in other types of low-pressure mercury lamps. One example of this modification is explained below.

Figure 8:
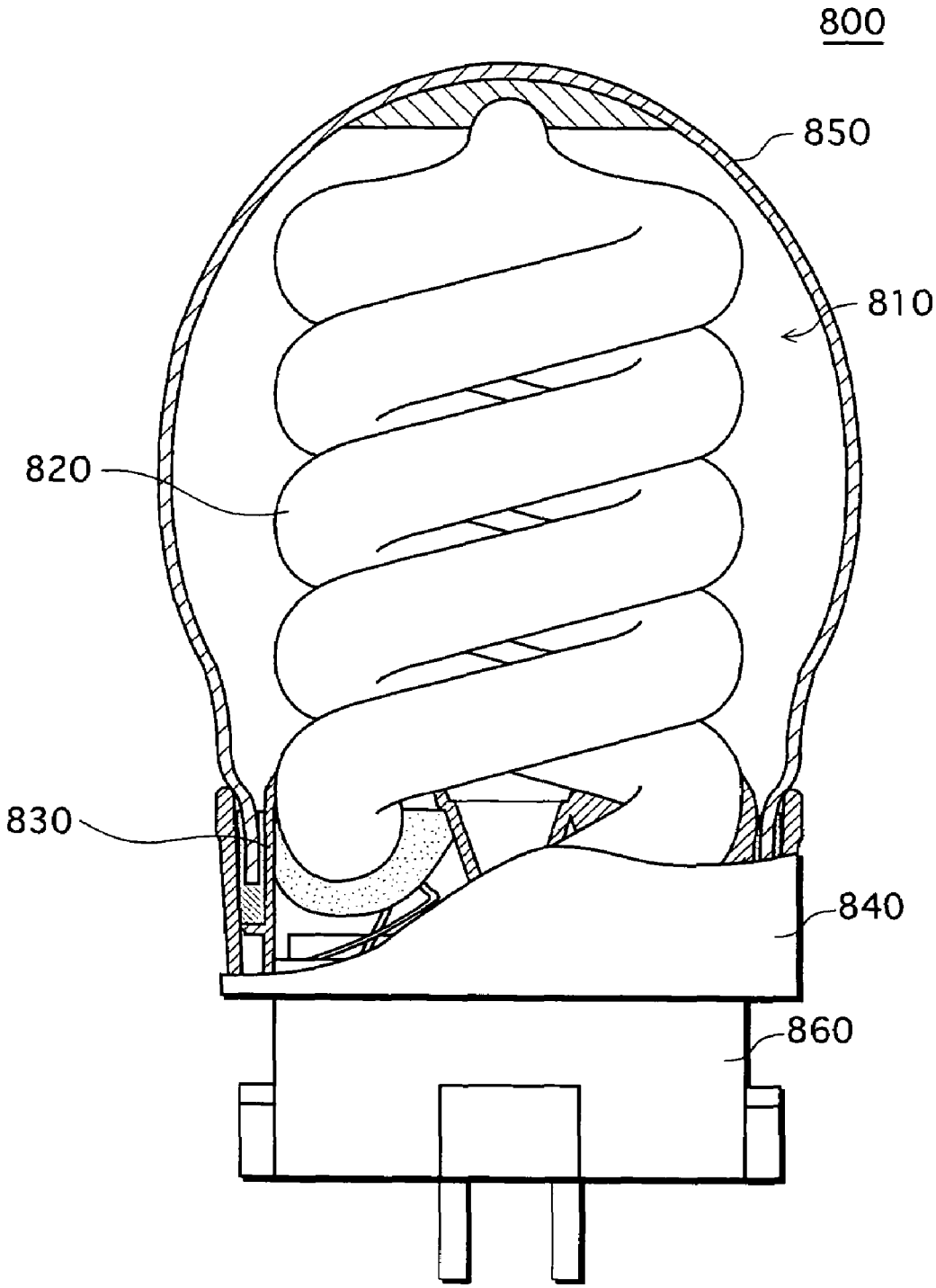
FIG. 8 is a partial cutaway front view of a fluorescent lamp as a modification to the embodiments.

FIG. 8 shows a fluorescent lamp 800 which is one type of low-pressure mercury lamp.

In the drawing, the fluorescent lamp 800 includes a double-spiral arc tube 810 formed by spirally winding a glass tube 820 to both ends, a cylindrical holding member 830 with a closed bottom for holding the arc tube 810 (at both ends of the glass tube 820), a case 840 covering a circumferential wall of the holding member 830, a globe 850 covering the arc tube 810, and a single base 860 (e.g. GX10q type) to be fit in a socket of a lighting fixture to receive power. Here, the globe 850 may be omitted as in the above embodiments.

This fluorescent lamp 800 differs from the compact self-ballasted fluorescent lamp 100, in that an electronic ballast is not provided in the holding member 830 and the case 840 and that the base 860 is not a screw base used in incandescent lamps.

The invention can also be applied to other types of low-pressure mercury lamps, such as those with a straight-type arc tube or a circular-type arc tube.

(5) The above embodiments describe the case where the filament coil is wound substantially one turn in the last coiling stage. However, the number of turns of the filament coil in the last coiling stage is not limited to such. In the case of a triple-coiled filament used in the above embodiments, for instance, the same effects as the above embodiments can be achieved so long as the winding pitch of the last coiling stage is no less than ($\phi_c$ +0.2) mm where $\phi_c$ denotes the outside diameter of the secondary coil and the length of the filament coil along the direction of the coil axis is no more than ($\phi_i$−1.6) mm where $\phi_i$ denotes the inside diameter of the glass tube.

If the winding pitch of the last coiling stage is no less than ($\phi_c$ +0.2) mm, a coil touch of adjacent winding turns of the filament coil and a coil touch of adjacent winding turns of the primary or secondary coil can be avoided even if the filament coil touches the inside surface of the arc tube body and becomes deformed when the electrode is being inserted into the end of the arc tube body.

Also, if the length of the filament coil along the direction of the coil axis is no more than ($\phi_i$ −1.6) mm, the electrode can be easily inserted into the end of the arc tube body.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. An arc tube comprising:

an arc tube body formed from a glass tube having an inside diameter in a range of 5 mm to 9 mm; and a pair of electrodes of a hot-cathode type sealed at both ends of the arc tube body, each of the electrodes including a filament that has been coiled multiple times and which is spirally wound by one turn in a last coiling stage so that a part of the filament corresponding to the turn does not exist in one plane.

2. The arc tube of claim 1, wherein the filament has been coiled three times, and is supported by a pair of lead wires mounted on a bead.

3. The arc tube of claim 1, wherein mercury is enclosed in the arc tube body substantially in a single form, and a starting voltage of the arc tube is set to be no greater than 900 V.

4. The arc tube of claim 1, wherein $L_F \leqq (\phi_i - 1.6)$ mm where $L_F$ denotes a length of the multiple-coiled filament measured along a coiling axis and $\phi_i$ denotes the inside diameter of the glass tube.

5. The arc tube of claim 2, wherein the arc tube body is formed by double-spirally winding the glass tube from a middle portion to both ends around a spiral axis.

6. The arc tube of claim 5, wherein an outside diameter of a double-spiral structure of the arc tube body is in a range of 30 mm to 40 mm.

7. The arc tube of claim 5, wherein portions of the pair of lead wires located in the arc tube body are at least partially bent along a corresponding end of the arc tube body shaped in double spiral.

8. The arc tube of claim 6, wherein portions of the pair of lead wires located in the arc tube body are at least partially bent along a corresponding end of the arc tube body shaped in double spiral.

9. A low-pressure mercury lamp comprising the arc tube of claim 1.

* * * * *